US006725620B2

(12) United States Patent
Dai

(10) Patent No.: US 6,725,620 B2
(45) Date of Patent: Apr. 27, 2004

(54) SEALING MOLD ARRANGEMENT FOR DOOR AND WINDOW FRAMES

(75) Inventor: Lin Jun Dai, Azusa, CA (US)

(73) Assignee: Wei Chen International Inc., Ontario, CA (US)

( * ) Notice: Subject to any disclaimer, the term of this patent is extended or adjusted under 35 U.S.C. 154(b) by 49 days.

(21) Appl. No.: 10/042,468

(22) Filed: Jan. 10, 2002

(65) Prior Publication Data

US 2003/0126825 A1 Jul. 10, 2003

(51) Int. Cl.[7] ..... E04C 2/38; E04B 2/00

(52) U.S. Cl. ..... 52/717.01; 52/717.03; 52/717.05; 52/204.205

(58) Field of Search ..... 52/287.1, 288.1, 52/204.705, 717.03, 717.04, 717.05, 717.06, 204.1, 204.62, 204.5, 204.53, 211; 49/9, 34, 472–474, 475.1–500.1, 507

(56) References Cited

U.S. PATENT DOCUMENTS 1,830,108 A * 11/1931 Jackson ..... 52/287
1,964,557 A * 6/1934 Brezinski ..... 52/287
3,302,350 A * 2/1967 Brown et al. ..... 52/287
3,399,504 A * 9/1968 Smith ..... 52/287
4,150,517 A * 4/1979 Warner, Sr. ..... 52/288
4,520,605 A * 6/1985 Budd ..... 52/287
5,179,811 A * 1/1993 Walker ..... 52/287

* cited by examiner

*Primary Examiner*—Jeanette Chapman
(74) *Attorney, Agent, or Firm*—Raymond Y. Chan; David and Raymond Patent Group

(57) ABSTRACT

A sealing mold arrangement includes at least an elongated mold strip adapted for mounting to an attachment corner edge of a panel frame such as a door and window frame. The elongated mold strip has an elongated first and second attachment surfaces and an alignment corner edge formed at a common line-edge where the first attachment surface meets the second attachment surface. Each of the first and second attachment surfaces has a longitudinally extended positioning guider sharp edge, a longitudinal attachment groove transversally extended from the positioning guider sharp edge towards an inner portion of the respective first and second attachment surfaces, and an edge gap surface transversally and inclinedly extended from the positioning guider sharp edge to the distal side edge of the respective first and second attachment surface to form an edge gap.

2 Claims, 6 Drawing Sheets

SEALING MOLD ARRANGEMENT FOR DOOR AND WINDOW FRAMES

BACKGROUND OF THE PRESENT INVENTION

1. Field of Invention

The present invention relates to door and window frames, and particularly to a sealing mold arrangement for a panel frame, which is facilitated for a user to mount an elongated mold strip on the panel frame without pre-aligning adjustment.

2. Description of Related Arts

FIG. 1A illustrates a conventional method of mounting an elongated strip on a panel frame such a door frame, wherein glue is applied on attachment surfaces of the elongated strip in such a manner that the elongated strip can be directly adhered on a edge corner of the door frame. However, there is hassle for a user that the glue must be evenly applied on the attachment surfaces of the elongated strip. Otherwise, an uneven adhesive layer on the attachment surface of the elongated strip will cause the misalignment of the elongated strip on the edge corner of the door frame.

FIG. 1B illustrates another conventional method of mounting the elongated strip on the window frame for mounting a pane, such as a glass, thereon, wherein an elongated slider groove is formed on an inner side of the window frame such that the pane is slidably inserted into the slider groove, so as to mount the pane to the window frame. However, a width of the slider groove must be larger than a thickness of the pane in order to fit the pane into the slider groove so as to form a clearance therebetween. Therefore, the pane will be vibrated when an external force, such as wind blowing or opening/closing the window frame is exerted on the pane, such that the pane especially a glass pane will be cracked easily. Since the pane is permanently installed into the window frame, the broken pane cannot be repaired easily. Moreover, water or dirt may store in the clearance, which is hard to clean up. In other words, such conventional method fails not only to securely mount the pane to the window frame but also to provide noise reduction ability.

Accordingly, a need will be seen for providing a sealed connection between the pane and the window frame. An improved method as shown in FIG. 1C is that the frame has a L-shaped cross section structure to define an inner boundary frame that the pane is mounted to the boundary frame. The elongated strip is mounted on the pane so as to sandwich the pane between the boundary frame and elongated strip. Usually a glue such as silicon is applied on the elongated strip such that the elongated strip can be sealedly attached to the boundary frame and the pane as shown in FIG. 1C. In order to securely mount the elongated strip to the boundary frame, a predetermined amount of glue is required. However, it is impossible to apply the glue having evenly thickness on entire attachment surfaces of the elongated strip such that when the elongated strip is mounted on the boundary frame, the elongated strip will be out of alignment, which will destroy the aesthetic appearance of the window frame. In order to prevent the misalignment of the elongated strip, less amount of glue can be used. However, the adhesive ability of the elongated strip will be substantially reduced, so as to fail to provide the air seal connection of the elongated strip. Otherwise, extra glue is needed to be applied along the edges of the elongated strip to seal the edges between the pane and the elongated strip. In other words, the mounting application is complicated and difficult for a user to operate and control with quality concerned.

SUMMARY OF THE PRESENT INVENTION

A main object of the present invention is to provide a sealing mold arrangement for a panel frame such as door and window frames, which is facilitated to align for mounting an elongated mold strip on the panel frame without any pre-aligning adjustment. The glue on the elongated mold strip will be evenly distributed on the attachment surfaces thereof wherein excess glue on the elongated mold strip will be automatically discharged out of the elongated mold strip. In other words, a user does not need to worry about how much glue is needed to be applied on the elongated mold strip to form an even adhesive layer.

Another object of the present invention is to provide a sealing mold arrangement for a panel frame such as door and window frames, wherein the sealing mold arrangement is capable of sealedly mounting a pane such as a glass on the panel frame without altering the original structural design of the panel frame.

Another object of the present invention is to provide a sealing mold arrangement for a panel frame such as door and window frames, wherein no additional glue is required to apply on the elongated mold strip after installation to seal the clearance between the panel frame and the elongated mold strip, so as to simplify the step of installation and reduce the installation cost of the panel frame.

Another object of the present invention is to provide a sealing mold arrangement for a panel frame such as door and window frames, which provides a substantial support without altering or complicating the original structure of the panel frame.

Another object of the present invention is to provide a sealing mold arrangement for a panel frame such as door and window frames, wherein no expensive or complicated structure is required to employ in the present invention in order to achieve the above mentioned objects. Therefore, the present invention successfully provides an economic and efficient solution for providing reinforced sealing configuration for the elongated mold strip mounted to the panel frame.

Accordingly, in order to accomplish the above objects, the present invention provides a sealing mold arrangement for a panel frame, which comprises at least an elongated mold strip adapted for mounting to a first frame surface and a second frame surface of an attachment corner edge of the panel frame having an interior angle defined between the first and second frame surfaces. The elongated mold strip has a longitudinal decorative surface and an elongated first and second attachment surfaces which are longitudinally extended to define an attachment angle, which is not more than 90 degrees, between the first and second attachment surfaces and an alignment corner edge formed at a common line-edge where the first attachment surface meets the second attachment surface. The decorative surface is extended between distal side edges of the first and second attachment surfaces.

The first attachment surface has a longitudinally extended first positioning guider sharp edge, a first longitudinal attachment groove transversally extended from the first positioning guider sharp edge towards an inner portion of the first attachment surface, and a first edge gap surface transversally and inclinedly extended from the first positioning guider sharp edge to the distal side edge of the first attachment surface to form a first edge gap.

The second attachment surface has a longitudinally extended second positioning guider sharp edge, a second longitudinal attachment groove transversally extended from the second positioning guider sharp edge towards an inner portion of the second attachment surface, and a first edge gap surface transversally and inclinedly extended from the second positioning guider sharp edge to the distal side edge of the second attachment surface to form a second edge gap.

The attachment angle is approximately equal to the interior angle such that the alignment corner edge and the first and second positioning guider sharp edges are functioning as three alignment points and capable of coincidentally mounting on the first and second frame surfaces respectively, so as to sealedly mount the elongated mold strip on the attachment corner edge of the panel frame when an adhesive substance is applied on the first and second attachment surfaces of the elongated mold strip while excess adhesive substance is discharged from the first and second edge gaps.

DETAILED DESCRIPTION OF THE PREFERRED EMBODIMENT

Figure 1A:
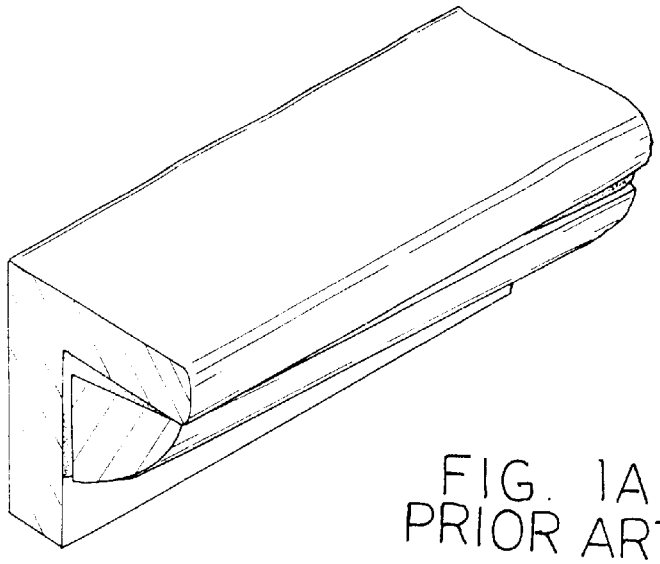
FIG. 1A PRIOR ART
FIG. 1A is a perspective view of a conventional door frame.
Figure 1B:
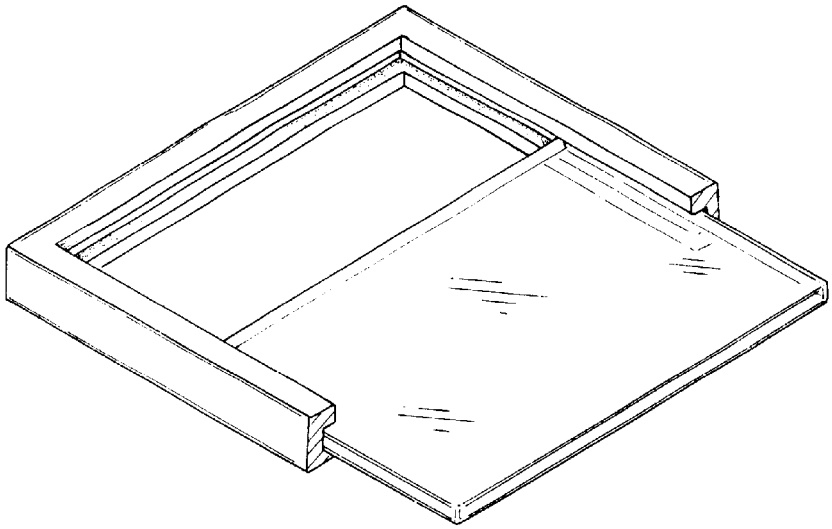
FIG. 1B PRIOR ART
FIG. 1B is a perspective view of a conventional window frame.
Figure 1C:
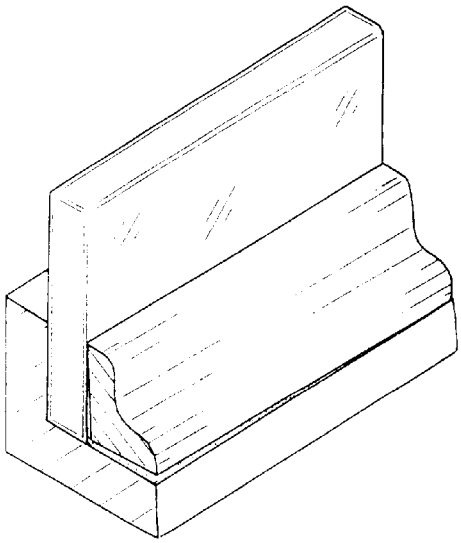
FIG. 1C PRIOR ART
FIG. 1C is a perspective view of another conventional window frame.
Figure 2:
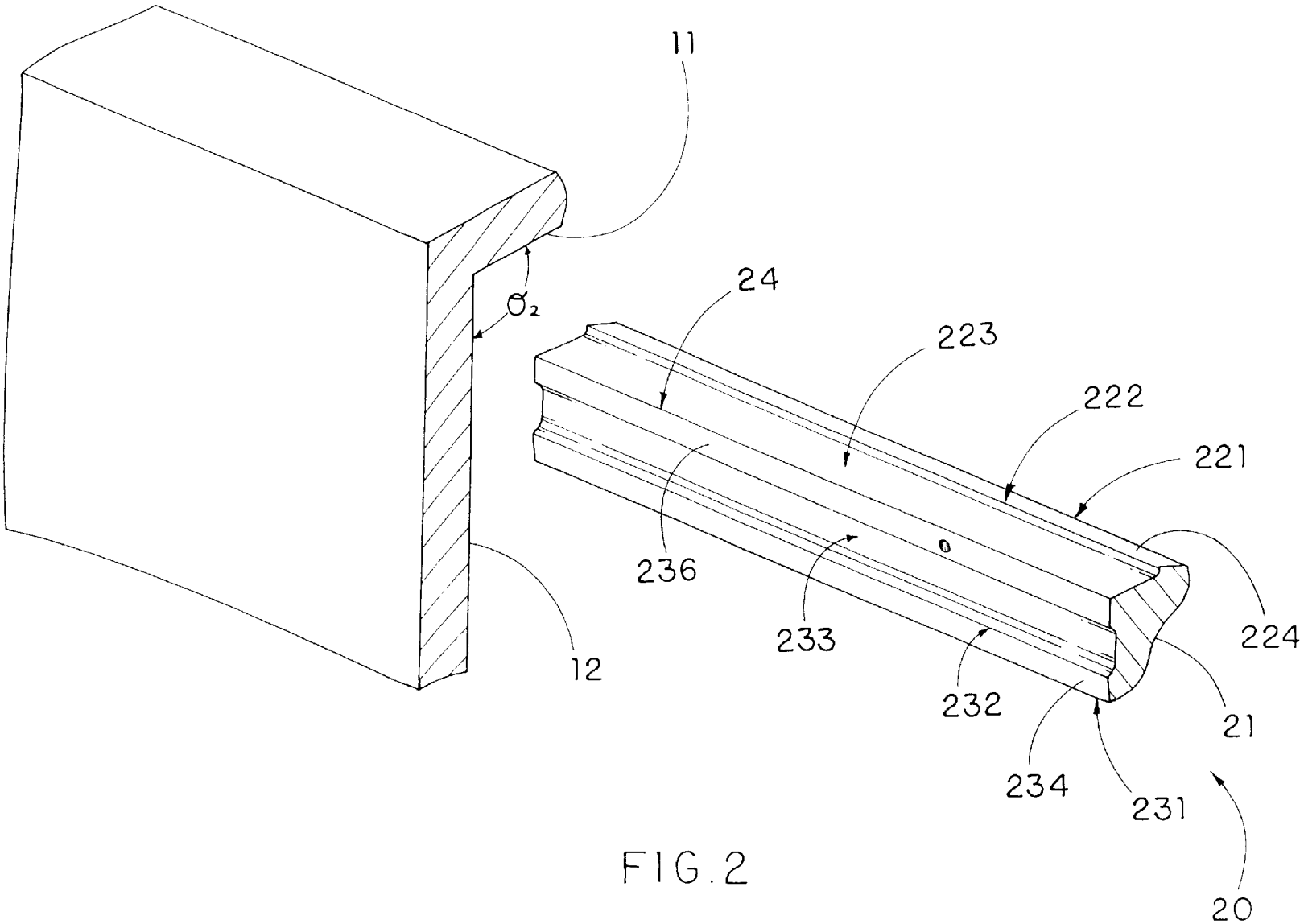
FIG. 2 is a perspective view of a sealing mold arrangement for a panel frame according to a preferred embodiment of the present invention.
Figure 3:
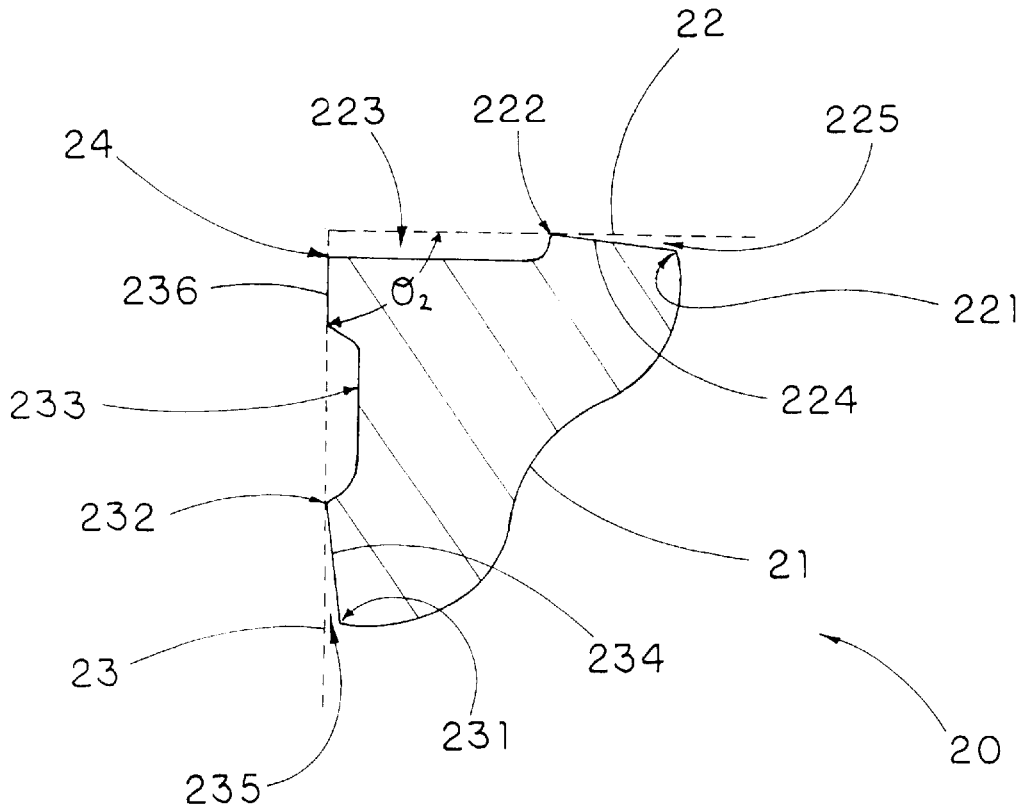
FIG. 3 is a sectional view of an elongated mold strip of the sealing mold arrangement according to the above preferred embodiment of the present invention.

Referring to FIGS. 2 and 3 of the drawings, a sealing mold arrangement 2 for a panel frame 1 according to a preferred embodiment of the present invention is illustrated, wherein the sealing mold arrangement 2 is adapted for alignigly mounting on the panel frame 1, such as a window frame or a door frame, in an air sealed manner.

The sealing mold arrangement 2 comprises at least an elongated mold strip 20 adapted for mounting to a first frame surface 11 and a second frame surface 12 of an attachment corner edge 10 of the panel frame 1 having an interior angle $\theta_1$ defined between the first and second frame surfaces 11, 12.

The elongated mold strip 20 has a longitudinal decorative surface 21 and an elongated first and second attachment surfaces 22, 23 which are longitudinally extended to define an attachment angle $\theta_2$, which is not more than 90 degrees, between the first and second attachment surfaces 22, 23 and an alignment corner edge 24 formed at a common line-edge where the first attachment surface 22 meets the second attachment surface 23. The decorative surface 21 is extended between distal side edges 221, 231 of the first and second attachment surfaces 22, 23.

The first attachment surface 22 has a longitudinally extended first positioning guider sharp edge 222, a first longitudinal attachment groove 223 transversally extended from the first positioning guider sharp edge 222 towards an inner portion of the first attachment surface 22, and a first edge gap surface 224 transversally and inclinedly extended from the first positioning guider sharp edge 222 to the distal side edge 221 of the first attachment surface 22 to form a first edge gap 225.

The second attachment surface 23 has a longitudinally extended second positioning guider sharp edge 232, a second longitudinal attachment groove 233 transversally extended from the second positioning guider sharp edge 232 towards an inner portion of the second attachment surface 23, and a second edge gap surface 234 transversally and inclinedly extended from the second positioning guider sharp edge 232 to the distal side edge 231 of the second attachment surface 23 to form a second edge gap 235.

The attachment angle $\theta_2$ is approximately equal to the interior angle $\theta_1$ such that the alignment corner edge 24 and the first and second positioning guider sharp edges 222, 232 are capable of coincidentally mounting on the first and second frame surfaces 11, 12 respectively, so as to fittedly mount the elongated mold strip 21 on the attachment corner edge 10 of the panel frame 1. In other words, the elongated mold strip 21 contains three edge point alignments which are the alignment corner edge 24 and the first and second positioning guider sharp edges 222, 232 to align with the attachment corner edge 10 of the panel frame 1, so as to fittedly mount the elongated mold strip 21 to the panel frame 1 without any pre-aligning adjustment.

According to the preferred embodiment of the present invention, the first and second attachment surfaces 22, 23 are illustrated by phantom lines as shown in FIG. 3, which can clearly indicate the structure of the present invention.

The first longitudinal attachment groove 223 is extended from the first positioning guider sharp edge 222 to the alignment corner edge 24 wherein the first positioning guider sharp edge 222 is arranged for biasing against the first frame surface 11 in a line contacting manner. In other words, the first attachment groove 223 is indented on the first attachment surface 22 and longitudinally extended along the first attachment surface 22. In other words, both of the first and second longitudinal attachment grooves 223, 233 are transversally extended from the first and second positioning guider sharp edges 222, 232 respectively to coinciding meet at the alignment corner edge 24 wherein the alignment corner edge 24 is arranged for biasing against the second frame surface 12.

The second attachment surface 23 further has a longitudinal alignment surface 236 coinciding extended along the alignment corner edge 24 to a distal edge end that the second longitudinal attachment groove 233 transversally extended therefrom wherein the alignment surface 235 is arranged for fittedly biasing against the second frame surface 12 of the attachment corner edge 10, so as to increase the contact surface area between the elongated mold strip 20 and the panel frame 1.

The first and second edge gap surfaces 224, 234 are inclinedly indented on the first and second attachment surfaces 22, 23 to define the first and second edge gaps 225, 235 respectively wherein each of the first and second edge gaps 225, 235 has a width gradually increasing from the respective first and second positioning guider sharp edge 222, 232 to the distal side edges 221, 231 of the first and second attachment surfaces 22, 23. In other words, each of the first and second edge gaps 225, 235 is formed between the respective first and second frame surfaces 11, 12 and the respective first and second edge gap surfaces 224, 234 when each of the first and second positioning guider sharp edges 222, 232 is biased against the respective first and second frame surfaces 11, 12.

Accordingly, each of the first and second longitudinal attachment grooves 223, 233 has an even depth wherein the depth of each of the first and second longitudinal attachment grooves 223, 233 is preferably at least larger than a width of each of the first and second edge gap 225, 235 at the distal side edges 221, 231 thereof.

Figure 4:
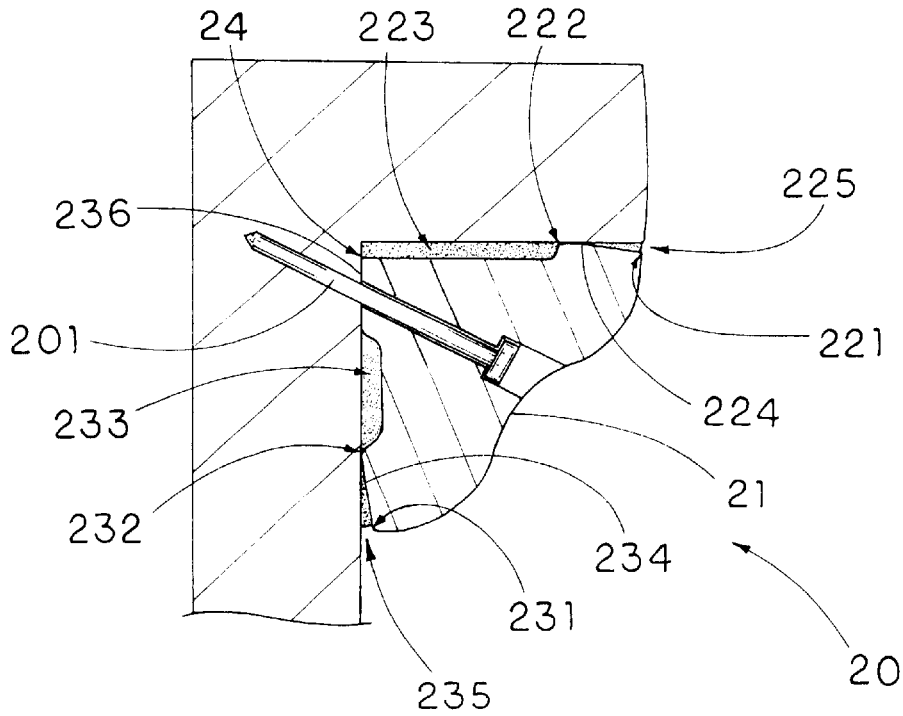
FIG. 4 illustrates an application of the sealing mold arrangement for a door frame according to the above preferred embodiment of the present invention.

As shown in FIG. 4, simply applying an adhesive substance A such as silicon on the first and second attachment surfaces 22, 23 of the elongated mold strip 20, the adhesive substance will be received in the first and second longitudinal attachment grooves 223, 233 respectively. When a pressing force is applied on the elongated mold strip 20 along the attachment corner frame 10 of the panel frame 1, such as a door frame, until the first and second attachment surfaces 22, 23 is biased against the first and second frame surfaces 11, 12 respectively, excess adhesive substance A in the first and second longitudinal attachment grooves 223, 233 will be forced and pressed towards the first and second edge gaps 225, 235 respectively.

Moreover, the excess adhesive substance A will be discharged out of the elongated mold strip 20 through the first and second edge gaps 225, 235 respectively. In other words, no unnecessary adhesive substance A will be remained on the first and second attachment surfaces 22, 23, so as to prevent the adhesive substance A unevenly applying on the first and second attachment surfaces 22, 23. Therefore, by aligning the alignment corner edge 24 and the first and second positioning guider sharp edges 222, 232 with the first and second frame surfaces 11, 12, the elongated mold strip 20 can be perfectly mounted on the attachment corner edge 10 of the panel frame 1 in a sealed manner. It is worth to mention that the excess adhesive substance A can be easily cleaned up so as to keep the aesthetic appearance of the panel frame 1.

As shown in FIG. 4, a mounting pin 201 can be used to further fasten the elongated mold strip 20 to the panel frame 1 by penetrating the mounting pin 201 through the elongated mold strip 20 to the panel frame 1 so as to ensure the secure attachment between the elongated mold strip 20 and the panel frame 1.

Figure 5:
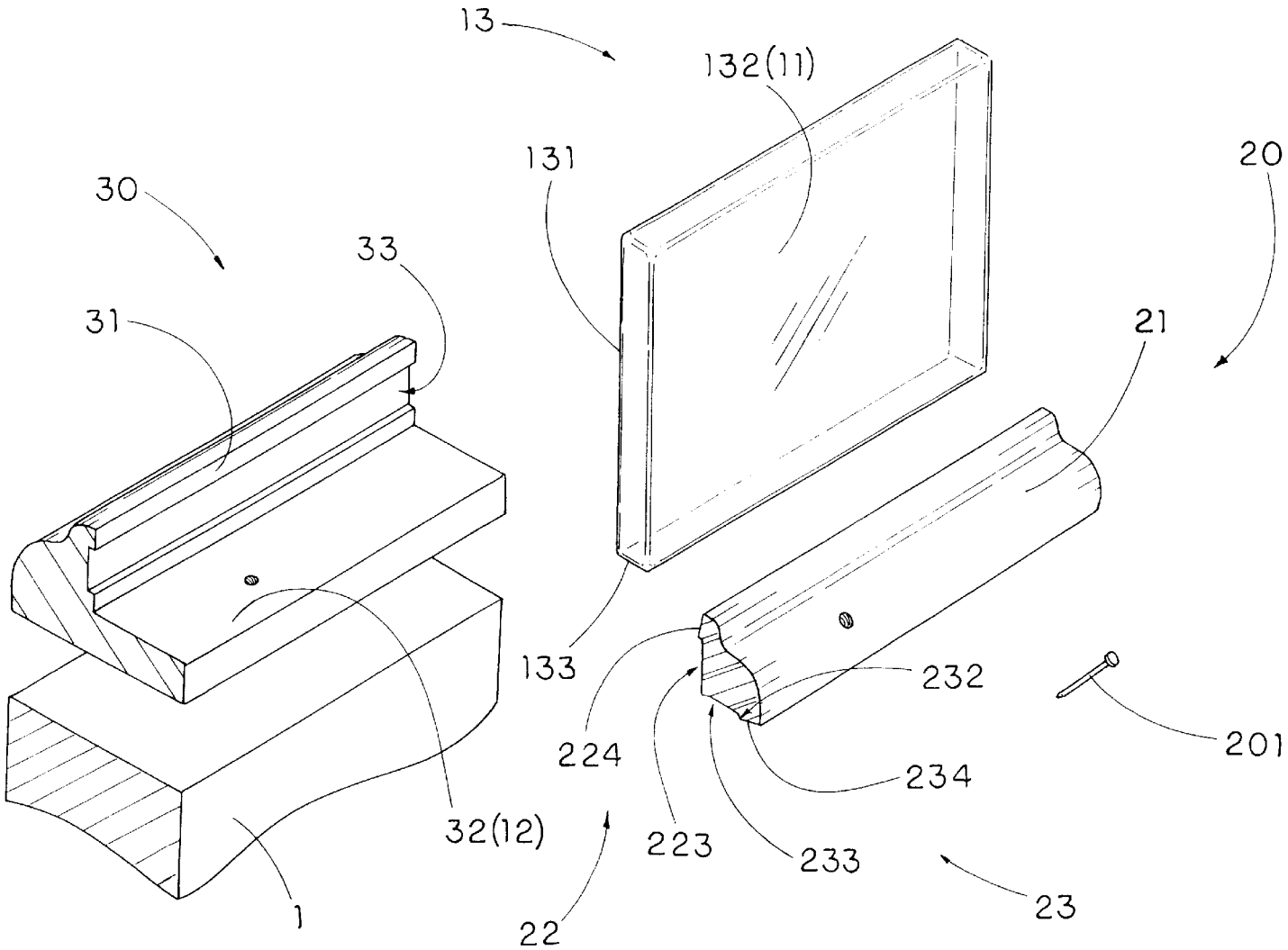
FIG. 5 is an exploded perspective view of the sealing mold arrangement for a window frame according to the above preferred embodiment of the present invention.

Referring to FIG. 5, the sealing mold arrangement 2 further comprises at least an elongated mold base 30 incorporated with the panel frame 1, such as a window frame, for mounting a pane 13, such as a glass, having a first pane surface 131, an opposed second pane surface 132, and an edge pane surface 133 extended between the first and second pane surfaces 131, 132.

Figure 7:
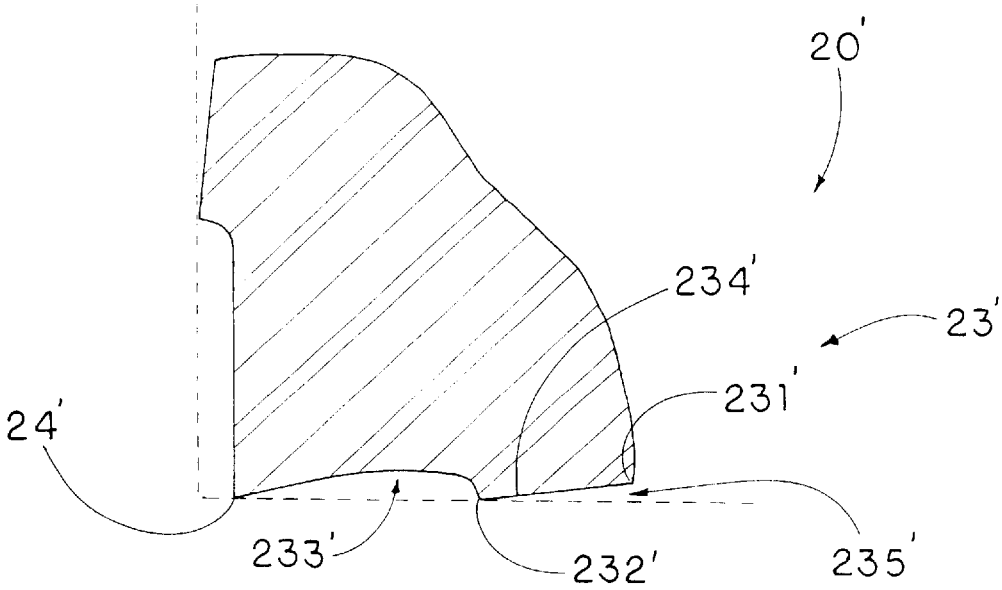
FIG. 7 illustrates a first alternative mode of the elongated mold strip of the sealing mold arrangement according to the above preferred embodiment of the present invention.

Accordingly, the elongated mold base 30, having a L-shaped cross section, has an elongated first and second molding surfaces 31, 32 which are longitudinally extended to define a molding angle $\theta_3$ equal to the attachment angle $\theta_2$ of the elongated mold strip 20, wherein a length of the second molding surface 32 is at least longer than a sum of lengths of the edge pane surface 133 and the second molding surface 32. As shown in FIG. 7, the elongated mold base 30 is capable of securely mounting on an elongated edge of the panel frame 1. Alternatively, the elongated mold base 30 can be integrally extended from the elongated edge of the panel frame 1 by cutting an edge portion of the panel frame 1 away to form a L-shaped elongated edge end of the panel frame 1.

Figure 6:
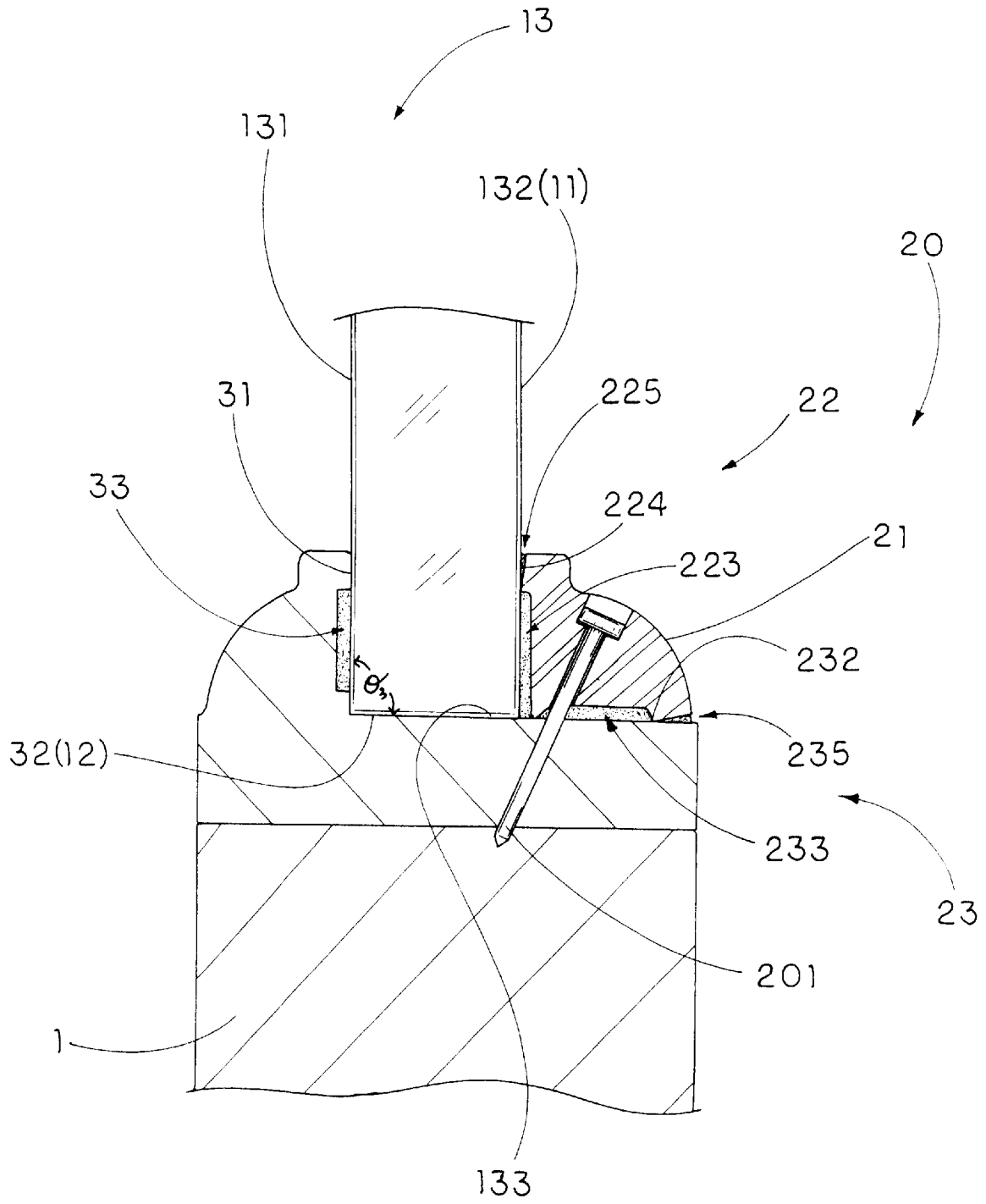
FIG. 6 illustrates an application of the sealing mold arrangement for the window frame according to the above preferred embodiment of the present invention.

The elongated mold base 30 is arranged for mounting to an edge portion of the pane 13 by fittedly biasing the first pane surface 131 against the first molding surface 31 and the edge pane surface 133 against the second molding surface 32. The first and second frame surfaces 11, 12 are defined by the second pane surface 132 of the pane 13 and the second molding surface 32 of the elongated mold base 30 respectively to form the attachment corner edge 10 therebetween. Therefore, the first attachment surface 22 of the elongated mold strip 20 is arranged for biasing against the second pane surface 132 (the first frame surface 11) of the pane 13 and the second attachment surface 23 of the elongated mold strip 20 is arranged for biasing against the second molding surface 32 (the second frame surface 12) of the pane 13. In other words, the first molding surface 31 of the elongated mold base 20 and the first attachment surface 22 of the elongated mold strip 20 is biased against the first and second pane surfaces 131, 132 of the pane 13 respectively so as to securely sandwiched the pane 13 between the elongated mold base 20 and the elongated mold strip 20, as shown in FIG. 6.

Accordingly, a longitudinal auxiliary attachment groove 33 is indented on the first molding surface 31 of the elongated mold base 30 such that the adhesive substance A can be applied on the first molding surface 31 and received in the auxiliary attachment groove 33 for adhesively mounting the first pane surface 131 of the pane 13 on the first molding surface 31.

Referring to FIG. 7, a first alternative mode of the second attachment surface 23' of the elongated mold strip 20' according to the preferred embodiment of the present invention is illustrated, wherein the second longitudinal attachment groove 233' is coinciding extended from the alignment corner edge 24' to the second positioning guider sharp edge 232'. The second longitudinal attachment groove 233' has a depth gradually increased from the alignment corner edge 24' to the second positioning guider sharp edge 232'. Preferably, the depth of the second longitudinal attachment groove 233' at the second positioning guider sharp edge 232' should be larger than a width of the second edge gap 235' at the distal side edge 231' of the second attachment surface 23', so as to ensure the excess adhesive substance A can be pressed out from the second longitudinal attachment groove 233' to the second edge gap 235'.

Figure 8:
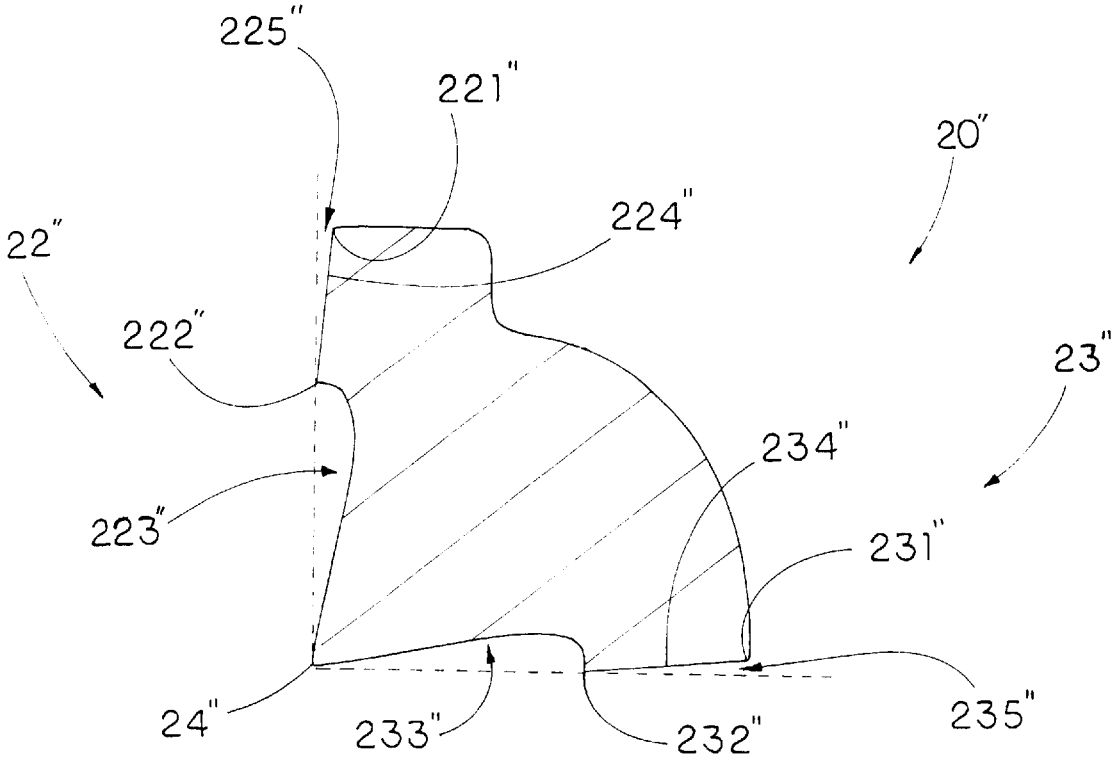
FIG. 8 illustrates a second alternative mode of the elongated mold strip of the sealing mold arrangement according to the above preferred embodiment of the present invention.

FIG. 8 illustrates a second alternative mode of the elongated mold strip 20" wherein both of the first and second longitudinal attachment grooves 223", 233" are transversally extended from the first and second positioning guider sharp edges 222", 232" respectively to coinciding meet at the alignment corner edge 24". The alignment corner edge 24" is arranged for biasing against the attachment corner edge 10 of the panel frame 1.

Each of the first and second longitudinal attachment grooves 223", 233" has a depth gradually increasing from the first and second positioning guider sharp edges 222", 232" to the alignment corner edge 24" respectively wherein the depth of each of the first and second longitudinal attachment grooves 223", 233" at the first and second positioning guider sharp edges 222", 232" respectively is larger than a width of each of the first and second edge gaps 225", 235" at the distal side edges 221", 231" respectively.

What is claimed is:

1. A sealing mold arrangement for a panel frame, comprising:

at least an elongated mold strip, adapted for mounting to a first frame surface and a second frame surface of an attachment corner edge of said panel frame having an interior angle defined between said first and second frame surfaces, wherein said elongated mold strip has a longitudinal decorative surface and an elongated first and second attachment surfaces which are longitudinally extended to define an attachment angle, which is not more than 90 degrees, between said first and second attachment surfaces and an alignment corner edge formed at a common line-edge where said first attachment surface meets said second attachment surface, wherein said decorative surface is extended between distal side edges of said first and second attachment surface;

wherein said first attachment surface has a longitudinally extended first positioning guider sharp edge, a first longitudinal attachment groove transversally extended from said first positioning guider sharp edge towards an inner portion of said first attachment surface, and a first edge gap surface transversally and inclinedly extended from said first positioning guider sharp edge to said distal side edge of said first attachment surface to form a first edge gap;

wherein said second attachment surface has a longitudinally extended second positioning guider sharp edge, a second longitudinal attachment groove transversally extended from said second positioning guider sharp edge towards an inner portion of said second attachment surface, and a second edge gap surface transversally and inclinedly extended from said second positioning guider sharp edge to said distal side edge of said second attachment surface to form a second edge gap;

said attachment angle is being approximately equal to said interior angle wherein said alignment corner edge and said first and second positioning guider sharp edges are three alignment points for coincidentally mounting on said first and second frame surfaces respectively, so as to sealedly mount said elongated mold strip on said attachment corner edge of said panel frame by applying an adhesive substance on said first and second attachment surfaces of said elongated mold strip respectively while excess adhesive substance is discharged from said first and second edge gaps;

wherein said first longitudinal attachment groove is extended from said first positioning guider sharp edge to said alignment corner edge for biasing against said first frame surface of said panel frame in line contacting manner, wherein said second attachment surface further has a longitudinal alignment surface coinciding extended along said alignment corner edge to a distal edge end that said second longitudinal attachment groove transversally extended therefrom for fittedly biasing against said second frame surface of said panel frame;

wherein said first and second edge gap surfaces are inclinedly indented on said first and second attachment surfaces to define said first and second edge gaps respectively wherein each of said first and second edge gaps has a width gradually increasing from said respective first and second positioning guider sharp edges to said respective distal side edges of said first and second attachment surfaces;

wherein both of said first and second longitudinal attachment grooves are transversally extended from said first and second positioning guider sharp edges respectively to coinciding meet at said alignment corner edge which is arranged for biasing against said attachment corner edge of said panel frame.

2. The sealing mold arrangement, as recited in claim 1, wherein each of said first and second longitudinal attachment grooves has an even depth and said depth of each of said first and second longitudinal attachment grooves is at least larger than a width of each of said first and second edge gap at said distal side edges thereof.

* * * * *